United States Patent [19]

Loos

[11] 4,044,892

[45] Aug. 30, 1977

[54] CONTINUOUS PLUG GAUGER FOR CONTAINER OPENINGS

[76] Inventor: Theodore G. Loos, Oscawana Heights Road, Putnam Valley, N.Y. 10579

[21] Appl. No.: 680,196

[22] Filed: Apr. 26, 1976

[51] Int. Cl.[2] ..... B07B 13/04

[52] U.S. Cl. ..... 209/73; 209/82

[58] Field of Search ..... 209/73, 74, 82, 83, 209/88 R, 90; 198/670, 836; 33/174 L, 178 R

[56] References Cited

U.S. PATENT DOCUMENTS

| | | | |
|---|---|---|---|
| 2,596,342 | 5/1952 | McNutt et al. | 209/88 R |
| 2,618,425 | 11/1952 | Stover | 198/461 X |
| 2,837,127 | 6/1958 | Luther | 198/836 X |
| 3,862,496 | 1/1975 | Rysti et al. | 209/82 X |

*Primary Examiner*—Robert B. Reeves
*Assistant Examiner*—Fred A. Silverberg
*Attorney, Agent, or Firm*—Parmelee, Johnson & Bollinger

[57] ABSTRACT

An apparatus for continuously gauging containers has a feed screw to positively move the containers to be gauged along a straight line beneath an endless chain upon which are mounted a plurality of gauging devices. The endless chain has a lower reach spaced above the containers and an upper reach vertically spaced above the lower reach. Each gauging device has an axially movable "go-no go" gauge therein, and there is a horizontally movable reject pin on the gauge. The pin is moved horizontally to a reject position when the gauge indicates "no go" and the pin is then returned to its normal position before the gauges are moved to the beginning of the first or lower reach. At the end of the lower reach, each gauge is retracted and then extended as each gauge is moved into the beginning of the lower reach.

4 Claims, 14 Drawing Figures

FIG. 1
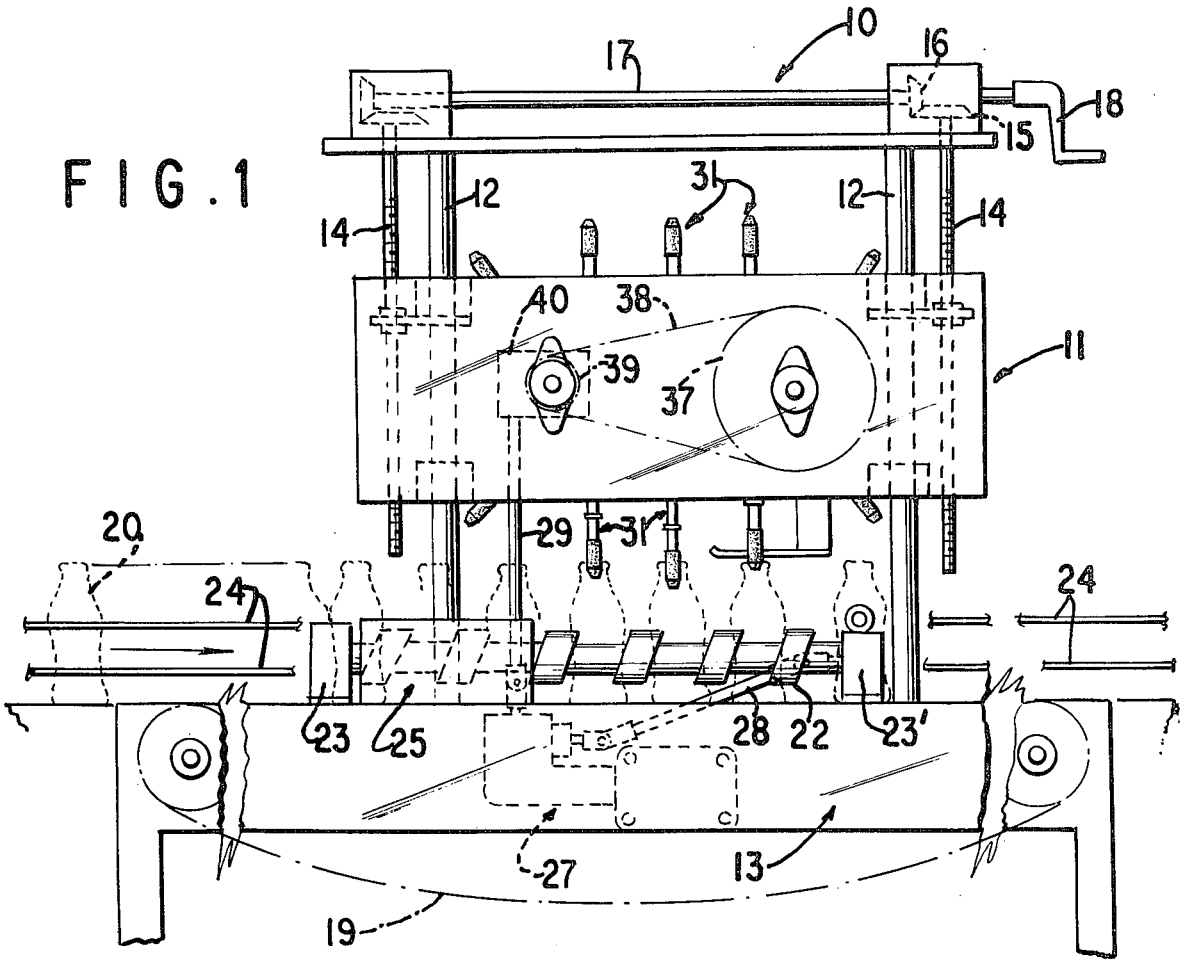
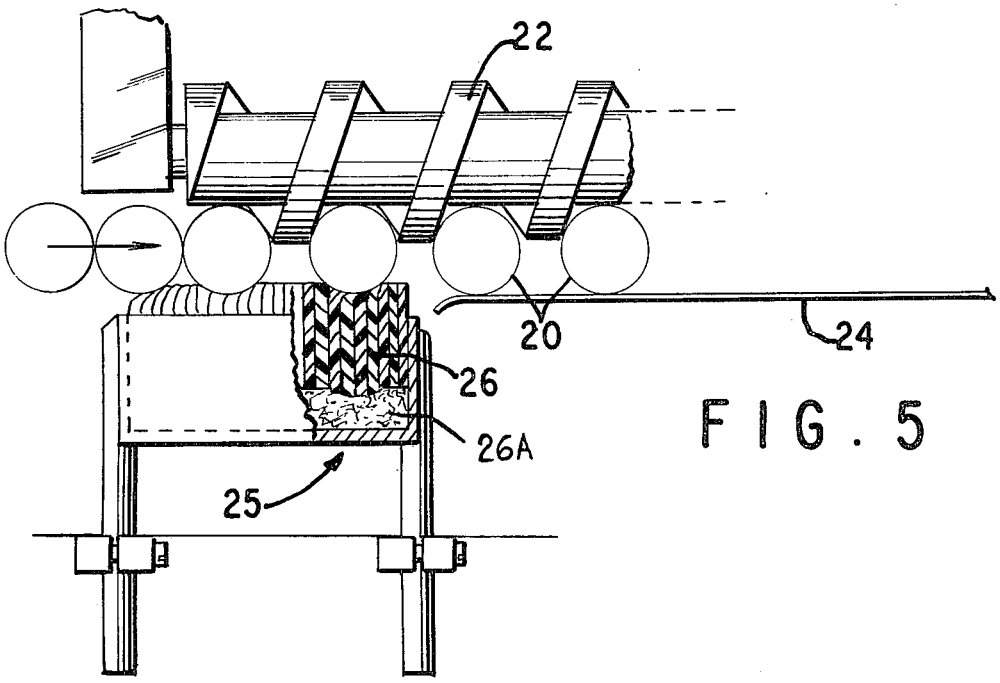
FIG. 5

CONTINUOUS PLUG GAUGER FOR CONTAINER OPENINGS

The present invention relates to the gauging of containers and, more particularly, to continuously gauging the openings of containers in transit.

In the production of containers, such as glass bottles, it is important that the size of the opening fall within certain tolerances in order to accommodate closures which may be subsequently attached to the bottles. It is further desirable that the openings be inspected or gauged as soon as possible after the production process so that any containers with openings which may be undersized may be quickly rejected. The production of such containers is at such a fast rate that difficulties are frequently encountered in gauging accurately and quickly the container openings.

It has been proposed to gauge such containers while they are moving by means of a gauging device which is positioned into each container as it is moved along a conveyor line. This means that the gauging device must not only move vertically so as to be inserted into and withdrawn from the opening but also must be moved horizontally so as to move in conjunction with the conveyed containers. Such a gauging apparatus had the disadvantage that its inspection rate was limited and thus could not be utilized effectively in conjunction with the high production rate of containers.

It is, therefore, an object of the present invention to provide an improved apparatus for gauging of containers.

It is another object of this invention to provide a reliable and effective apparatus for cntinuously gauging containers as they are being conveyed.

It is a further object to provide such a gauging apparatus employing an improved feed screw and guide means for conveying the containers to be gauged.

It is still another object of the invention to provide such a gauging apparatus which has an improved gauging device whose gauge can be quickly removed and replaced.

According to one aspect of the present invention, an apparatus for gauging containers may comprise means for conveying a plurality of containers to be gauged along a straight line and an endless chain is disposed above the conveying means and has a first run spaced above the surveying means and a second run spaced vertically above the first run. A plurality of gauging devices are mounted upon the chain and are spaced thereon according to the spacing between containers on the conveying means. Each gauging device has a go-no go gauge reciprocably mounted thereon and freely movable axially of the device between an extended gauging position and a retracted position. The gauge is provided with a horizontally movable pin and on the apparatus there are means for moving the pin horizontally to a reject position when the guage indicates no go. Means are also provided for returning the pin to its normal, non-reject position. The apparatus also comprises means for retracting each gauge when its gauging device is at the end of the first run. The gauges remain in their retracted positions through the second run and then move into their extended positions as each gauging device is moved to the beginning of the first run.

The gauge on each gauging device is detachably mounted thereon to facilitate replacement thereof.

These and other objects and features will become apparent from the following detailed description of the invention along with the attached drawings.

In the drawings:

FIG. 1 is an elevational view of the gauging apparatus according to the present invention;

FIG. 5 is a sectional view taken along the line 5—5 of FIG. 3;

Proceeding next to the drawings wherein like reference symbols indicate the same parts throughout the various views, a specific embodiment of the present invention will be described in detail.

Figure 2:
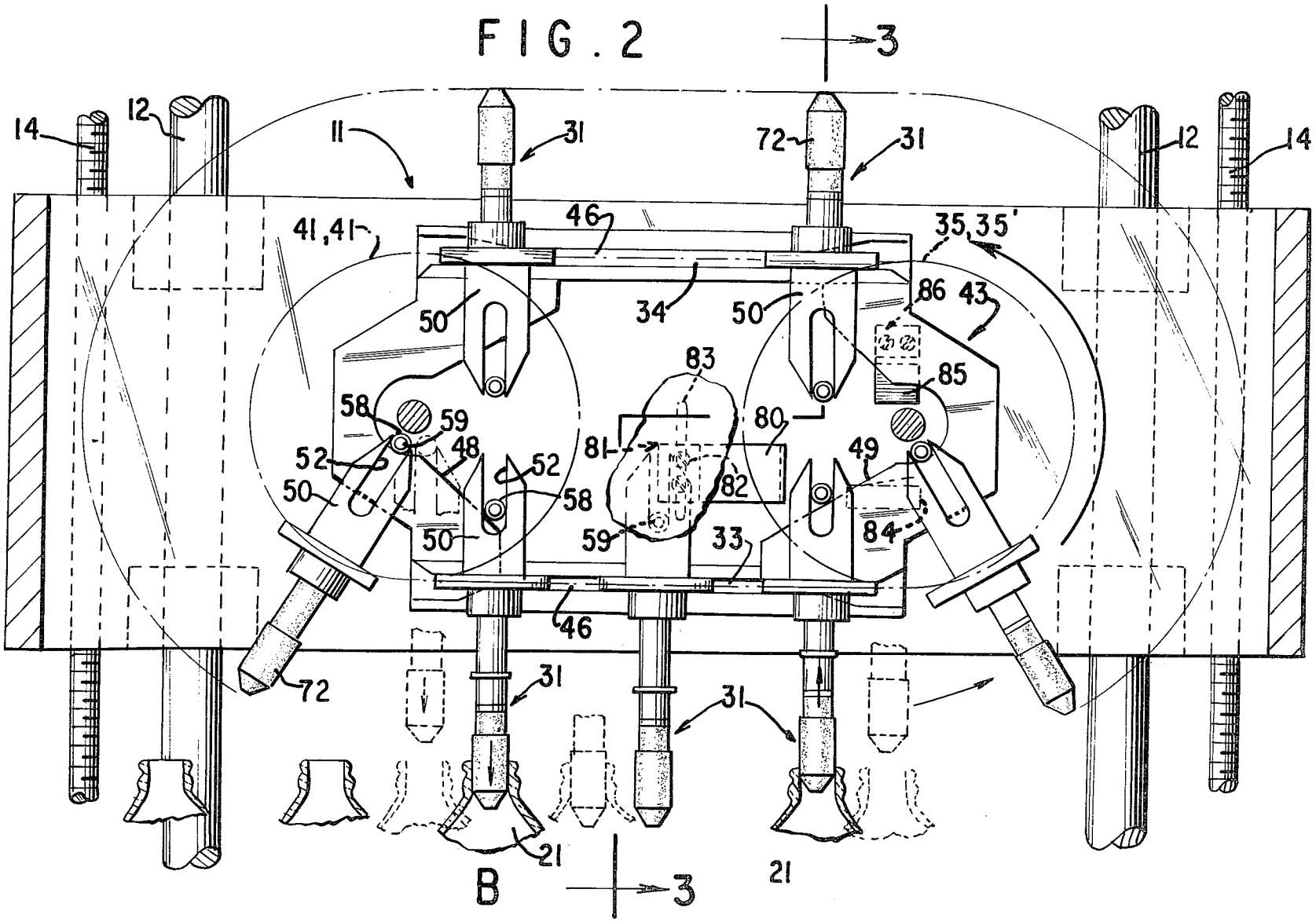
FIG. 2 is an elevational view in enlarged scale of the plug gauger assembly of the apparatus of FIG. 1 with portions of the gauger enclosure being removed.

In FIG. 1 there is indicated generally at 10 a gauging apparatus according to the present invention and which comprises a plug gauger unit 11 movably mounted on vertical rods 12 upstanding from a frame 13. The gauger unit 11 is vertically positionable along the rods 12 by threaded spindle rods 14 having beveled gears 15 at their upper end engaging with further beveled gears 16 mounted on a shaft 17 which can be manually rotated by a crank 18.

Mounted on the frame 13 is an endless belt conveyor 19 upon which containers 20 are moved underneath the plug gauger 11. The containers 20 in this particular embodiment are in the form of bottles having openings 21 (FIG. 2), the dimensions of which are to be checked by a go-no go gauge.

In addition to the endless conveyor belt 19, the bottles 20 are positively driven through the gauging station by means of a worm 22 formed of a synthetic plastic material such as a phenolic resin. The ends of the worm 22 are journalled in bearing boxes 23 and 23', one of which includes a driving connection for the worm in a manner known in the art.

Figure 3:
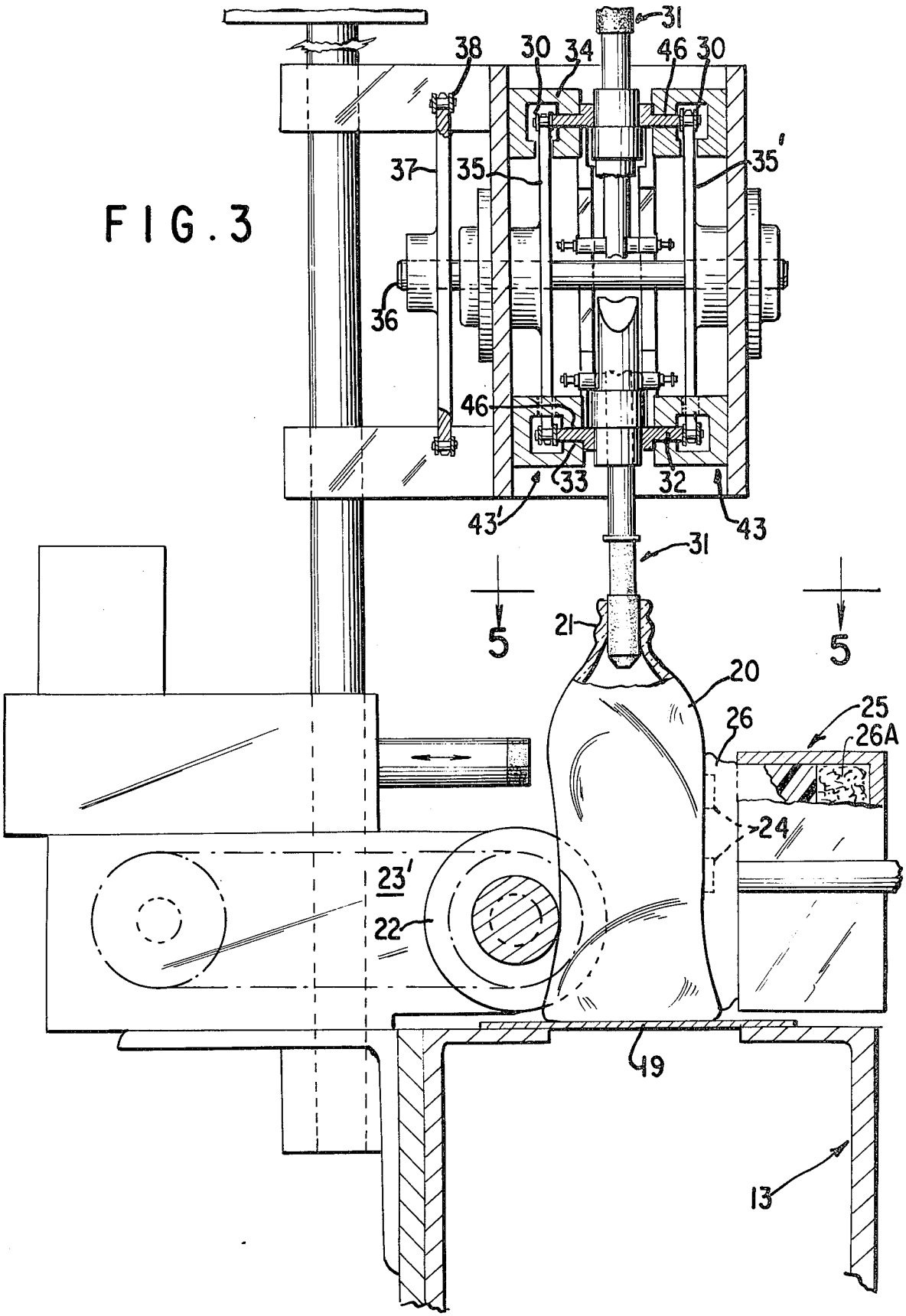
FIG. 3 is a sectional view taken along the line 3—3 of FIG. 2.

In order to maintain the containers 20 in driven relationship with the worm as shown in FIG. 5, guide rails 24 are provided which are positioned parallel to and horizontally spaced from the worm 22. A self-contained anti-shock mechanism 25 is positioned at the feed or inlet end of the worm 22 as shown in FIGS. 3 and 5 and comprises a resilient, easily deformable pad means 26 which conforms to the configuration of the bottles and is formed by multiple layers of plastic material movably held in a housing with exposed edges extending from the housing perpendicularly toward the worm. These exposed edges are spaced from the worm for permitting passage of the containers between them and the worm. Pad means 26 includes sponge-like material 26A in said housing engaging the inner edges of said plastic layers. This anti-shock mechanism 25 dampens the shock of the bottles 20 as they enter the feed worm 22.

The drive unit indicated at 27 (FIG. 1) may be mounted within the frame 13 to provide a driving connection at 28 to the worm bearing box 23'.

Figure 4:
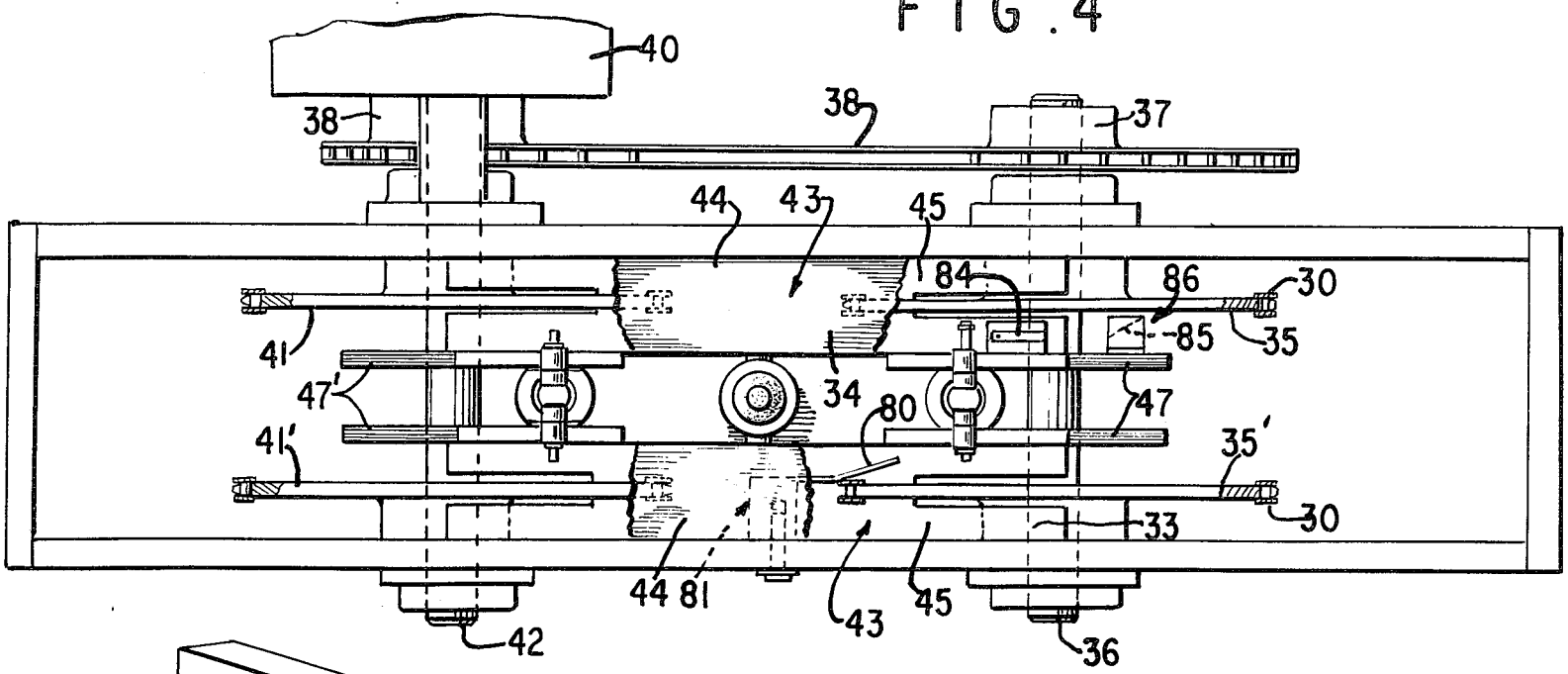
FIG. 4 is a top plan view of the plug gauger of FIG. 2.
Figure 13:
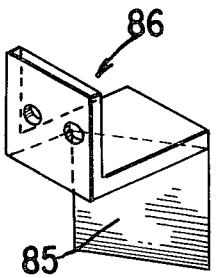
FIG. 13 is a perspective view of a further cam used to return the reject pin to its normal position.
Figure 12:
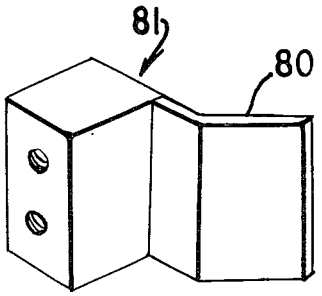
FIG. 12 is a perspective view of a cam for moving a reject pin on the gauging device to the reject position.

A second driving connection 29 extends vertically upwardly to the plug gauger 11 to drive a pair of endless chains 30 FIGS. 3 and 4 to which a plurality of gauging devices indicated at 31 are attached by plates 32. The endless chains 30 move in vertical planes and define a first run or lower reach 33 and a second run or upper reach 34. The chains 30 are positioned around sprockets 35 and 35' mounted upon a journalled shaft 36 and provided with a driving sprocket plug gear 37 around which is a driving chain 38 which passes over a driving pinion 39 extending from a transmission box 40.

Figure 11:
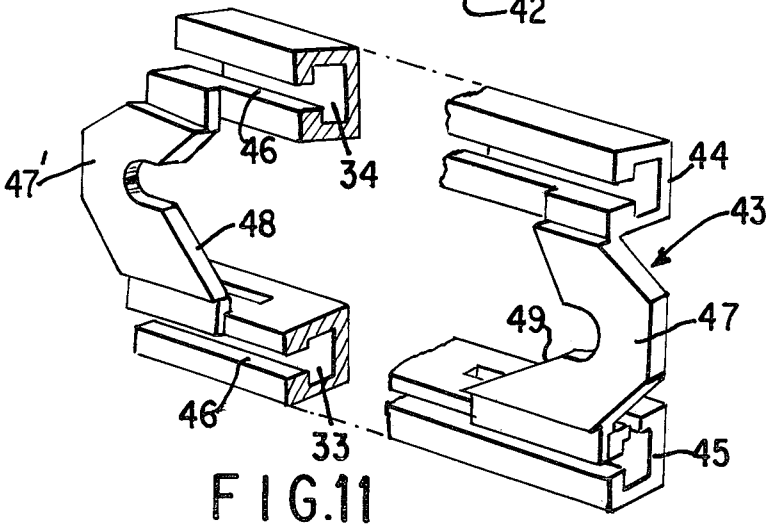
FIG. 11 is an overall perspective view of the guide rail assembly and cams for conveying and actuating the gauging devices.
Figure 7:
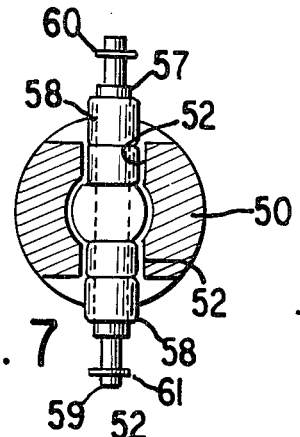
FIG. 7 is a sectional view taken along the line 7—7 of FIG. 6.

The chains 30 also pass over sprockets 41 and 41' journalled upon a shaft 42. Each chain 30 passes through a guide frame indicated generally at 43 in FIG. 11 and comprising an upper guide portion 44 and a lower guide portion 45. The guide portions have longitudinally extending slots 46 therein through which pass the plates 32 upon which the gauging devices 31 are mounted. The ends of the guides 44 and 45 are interconnected by members 47, 47' whose inner surfaces 48 and 49 form cam surfaces for retracting and extending the gauges in a manner to be subsequently described.

Figure 6:
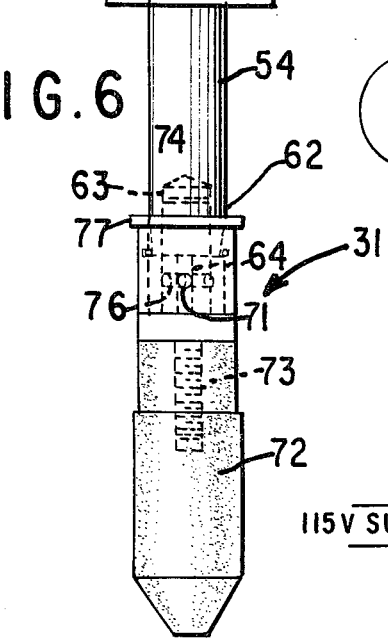
FIG. 6 is an elevational view of a gauging device utilized in the apparatus according to the present invention.
Figure 14:
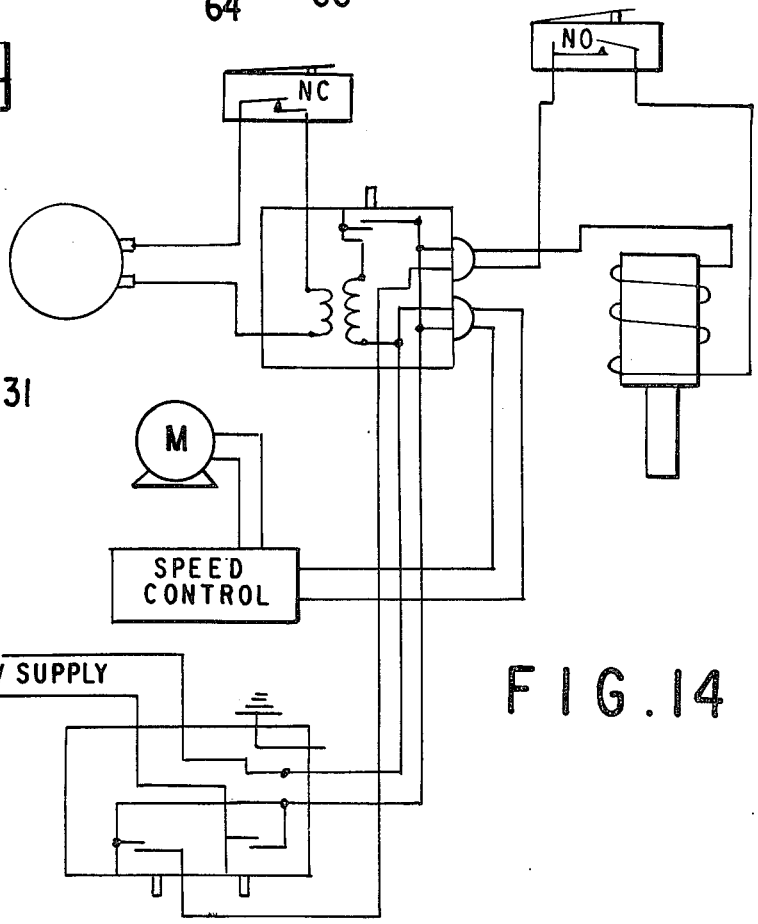
FIG. 14 is a schematic diagram showing the electrical connections for controlling and operating the several components of the apparatus of the present invention.

Each gauging device 31 comprises a body portion 50 and is shown in greater detail in FIG. 6. The body portion 50 has an axially extending bore 51 therethrough and one end of the body portion 50 has a pair of opposed longitudinal slots 52 extending therefrom and the edges of the body portion are beveled at 53. Slidably mounted within the bore 51 is a gauging member rod 54 whose movement is facilitated by means of linear anti-friction bearings 55 within the body portion.

The inner end of the gauging member 54 indicated at 56 is provided with a transversely extending rod 57 upon which are mounted rollers 58 so as to project at least partially beyond the outline of the body portion 50. Sildably mounted within the rod 57 is a reject pin 59 provided with stops 60 and 61 thereon to limit the horizontal sliding movement of the pin.

The lower end of gauging member 54 indicated at 62 is provided with a bore 63 which extends partially into the gauging member and the end thereof is provided with a pair of longitudinal slots 64. Extending circumferentially from the longitudinal slots 64 are slot portions 65 which are in the same direction of rotation.

A retaining sleeve 66 is mounted on end 62 of the gauging member for limited axial movement thereon. The sleeve 66 is retained upon the gauging member by means of an O-ring 67 received in an annular groove 68 and engageable with a shoulder 69 on the gauging member. The outer surface of the gauging member inwardly of the shoulder 69 is tapered as shown at 70 to permit limited movement of the O-ring 67 thereon.

The retaining sleeve 66 is provided with an inwardly directed pin 71 which is received in one of the slots 64.

Figure 8:
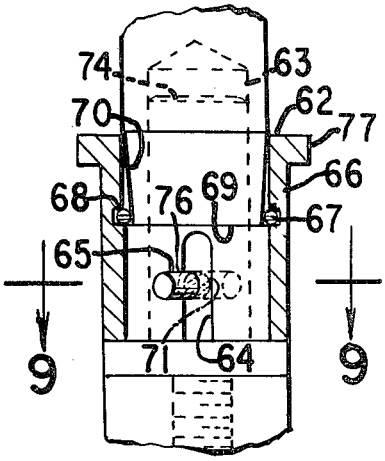
FIG. 8 is a longitudinal sectional view in enlarged scale of a portion of the gauging device of FIG. 6 illustrating the details of detachably connecting the gauge.
Figure 10:
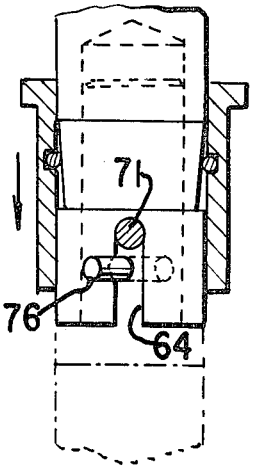
FIG. 10 is a view similar to that of FIG. 8 and showing the locking sleeve displaced axially to unlock the gauge connection.
Figure 9:
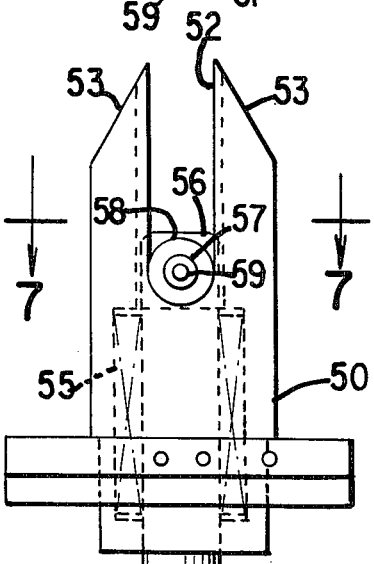
FIG. 9 is a sectional view taken along the line 9—9 of FIG. 8.
Figure 9:
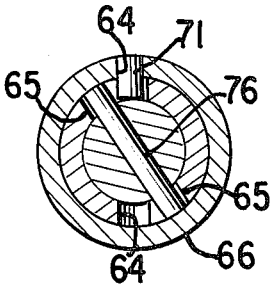

Mounted upon the end 62 of the gauging member is a go-no go gauge 72 of a synthetic plastic material and dimensioned so as to be inserted into bottle openings 21 having predetermined tolerances. The gauge 72 is threaded upon a shaft 73 which extends from a cylindrical rod portion 74 having a flange 75. The rod portion 74 is received within the bore 63 of the gauging member and has a transversely extending pin 76 thereon which is receivable in the locking slots 65. Upon being seated in the slot 65, the retaining sleeve 66 is moved axially downwardly as viewed in FIGS. 8 and 10 so that the pin 71 is positioned below the locking slots 65 to retain the pin 76 locked in position.

This detachable bayonet connection enables go-no go gauges of various sizes to be quickly replaced upon the gauging device while at the same time securely holding the gauges in position.

The upper end of retaining sleeve 66 is provided with a flange 77 which abuts against one end of the body portion 50 to limit axial movement of the gauging member 54 with respect to the body portion.

In operation, the chains 20 are continuously driven and the gauging devices 31 are continuously rotated around the track as defined by the guide frames 43. As each gauging device comes down around the left hand end of the guide frame as viewed in FIG. 2, the gauge will remain in the retracted position until its rollers 58 move off the downwardly inclined cam surface 48. At this point, each gauge 72 is vertical and begins its horizontal run through the testing operation. As each gauge becomes vertical, it is lowered into a bottle as viewed at B in FIG. 2. The gauge travels in this manner for a predetermined distance which, in the present embodiment, is about 5 inches. If the gauge is not lowered into the mouth 21 of a bottle because of an obstruction or some other defect in the mouth, the reject pin 59 is moved horizontally by the cam surface 80 of the cam block 81. The cam block 81 is mounted for vertical adjustment by means of its screws 82 passing through the slot 83.

The reject pin which has now been moved to its reject position strikes a reject gate switch 84 to actuate a suitable reset-reject mechanism, as known in the art, to reject the bottle into which the gauge will not pass. After the reject switch 84 has been actuated, the reset pin 59 is reset to its normal non-reject position by cam surface 85 on the cam block 86.

It is pointed out that when the gauge passes into a bottle, the reject pin will be positioned below the cam block 81 as can be seen in FIG. 2. It is only when the gauge will not pass into a bottle mouth that the reject pin will engage the cam surface 80 to be moved horizontally to its reject position.

As described above, the gauges 72 are held securely with a quick release mechanism and can be readily changed or replaced without the use of any tools.

It will be understood that various details of construction and arrangement of parts may be changed without departing from the spirit of the invention except as defined in the appended claims.

What is claimed is:

1. In an apparatus for gauging containers, the combination of means for conveying a plurality of containers to be gauged along a straight line, endless chain means disposed above said container conveying means straight line and having a first run spaced above said conveying means straight line and a second run spaced vertically above said first run, a guide frame for said chain means, a plurality of gauging devices mounted upon said chain means and spaced thereon corresponding to the spacing between said containers in said conveying means, each gauging device having a go-no go gauge reciprocally mounted thereon and freely movable axially of said device between an extended gauging position and a retracted position, a horizontally movable pin on said gauge, means for moving said pin horizontally to a reject position when said gauge indicates no go and for returning said pin to its normal non-reject position, means for retracting each of said gauges at the end of said first run, said gauges each remaining in their retracted positions through said second run and moving into their extended positions as each gauge is moved to the beginning of said first run, and said pin moving and returning means comprising first and second cams mounted on said guide frame.

2. In an apparatus as claimed in claim 1, a reject gate switch mounted on said guide frame and connected to reject mechanism for rejecting containers having a no go condition, said reject gate switch being located for actuation by each pin in its reject position before the pin is returned to its normal position by said second cam.

3. In an apparatus for gauging bottles, the combination of means for conveying a plurality of bottles to be gauged along a straight line, said conveying means including a feed worm, endless chain means disposed above said bottle conveying means straight line and having a first run spaced above said conveying means straight line and a second run spaced vertically above said first run, a plurality of gauging devices mounted upon said chain means and spaced thereon corresponding to the spacing between said bottles as the bottles are moving along said feed worms in said conveying means, each gauging device having a go-no go gauge reciprocally mounted thereon and freely movable axially of said device between an extended gauging position and a retracted position, means for sensing when any gauge indicates no go and for rejecting any bottle which is sensed as having a no go condition, means for retracting each of said gauges at the end of said first run, said gauges each remaining in their retracted positions through said second run and moving into their extended positions as each gauge is moved to the beginning of said first run, said conveying means including a guide rail extending along parallel to but horizontally spaced from said feed worm for conveying the bottles between said feed worm and said guide, said feed worm having an entry end for receiving the bottles, and self-contained anti-shock means horizontally spaced from the entry end of said feed worm and positioned ahead of said guide rail for admitting the bottles between said entry end of the feed worm and said anti-shock means, said anti-shock means including a housing, multiple layers of plastic material movably held by said housing with exposed edges extending from the housing perpendicularly toward the entry end of the feed worm, and sponge-like material in said housing engaging the opposite edges of said layers from said exposed edges.

4. In an apparatus for gauging containers, the combination of means for conveying a plurality of containers to be gauged along a straight line, endless chain means disposed above said container conveying means straight line and having a first run spaced above said conveying means straight line and a second run spaced vertically above said first run, a plurality of gauging devices mounted upon said chain means and spaced thereon corresponding to the spacing between said containers in said conveying means, each gauging device having a go-no go gauge reciprocally mounted thereon and freely movable axially of said device between an extended gauging position and a retracted position for insertion into the mouth of a container, a horizontally movable pin on said gauge, first cam means for moving each pin horizontally to a reject position when the gauge does not become inserted into the mouth of the container for indicating a no go condition, reject means located to be actuated by each pin in the reject position for rejecting each container having a no go condition, and second cam means for returning each pin to its normal non-reject position after said reject means has been actuated thereby.

* * * * *